United States Patent [19]

Lisak

[11] Patent Number: 4,999,873

[45] Date of Patent: Mar. 19, 1991

[54] HINGE BRAKE

[75] Inventor: Stephen P. Lisak, Arab, Ala.

[73] Assignees: Ryder International Corporation, Arab, Ala.; Textron, Inc., Providence, R.I.

[21] Appl. No.: 289,374

[22] Filed: Dec. 23, 1988

[51] Int. Cl.[5] ..... E05F 3/00; E05F 5/10

[52] U.S. Cl. ..... 16/84; 16/82

[58] Field of Search ..... 16/82, 84, 66, DIG. 21; 49/13; 188/297, 301, 322.13

[56] References Cited

U.S. PATENT DOCUMENTS

| | | | |
|---|---|---|---|
| 329,298 | 10/1885 | Elliott | 16/84 |
| 995,665 | 6/1911 | Danielson | 16/84 |
| 1,013,762 | 1/1912 | Gibbs | 16/84 |
| 2,209,733 | 7/1940 | Jones | 16/84 |
| 4,104,761 | 8/1978 | Lyons | 16/84 |
| 4,721,946 | 1/1988 | Zunkel | 49/13 |

*Primary Examiner*—Richard K. Seidel
*Assistant Examiner*—Carmine Cuda
*Attorney, Agent, or Firm*—R. A. Giangiorgi

[57] ABSTRACT

A hinge brake apparatus is provided for controlling the rate of either opening or closing of a door or the like. The hinge brake includes a cylinder member having a tubular-open-ended configuration and a piston member which axially slidably interfits in telescoping relation with the cylinder and forms a sliding seal therewith. A one-way air flow control arrangement is disposed adjacent the end of the cylinder opposite its open end for controlling the flow of air between the interior and the exterior of the cylinder in response to travel of the piston in at least one axial direction relative to the cylinder. A check valve arrangement is provided for permitting a relatively free and less impeded air flow between the exterior and interior of the cylinder in response to travel of the piston in the opposite axial direction. The check valve also serves to substantially confine any air flow to the air flow control arrangement in response to the travel of the piston relative to the cylinder in the first-mentioned direction.

17 Claims, 2 Drawing Sheets

FIG. 1
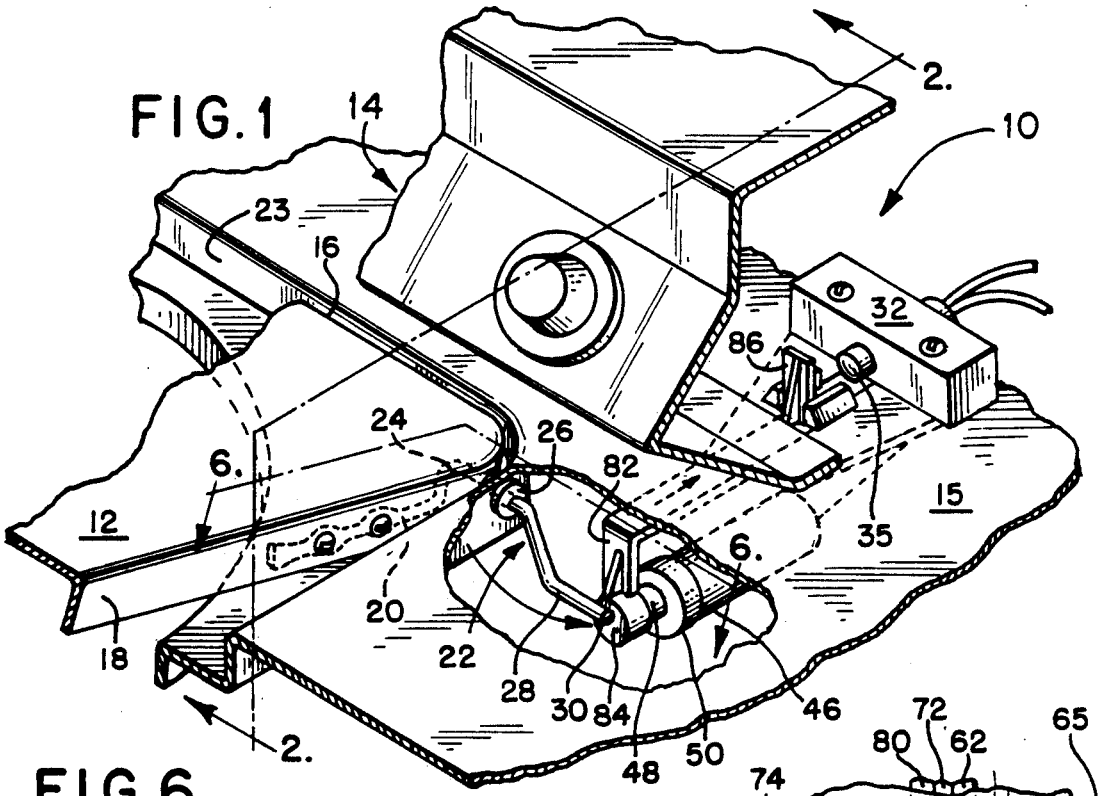
FIG. 6
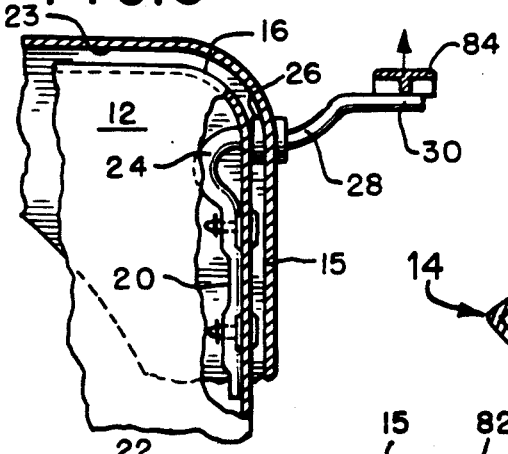
FIG. 7
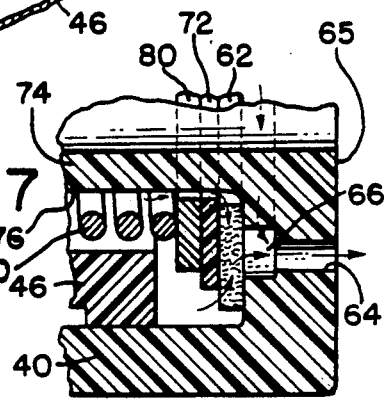
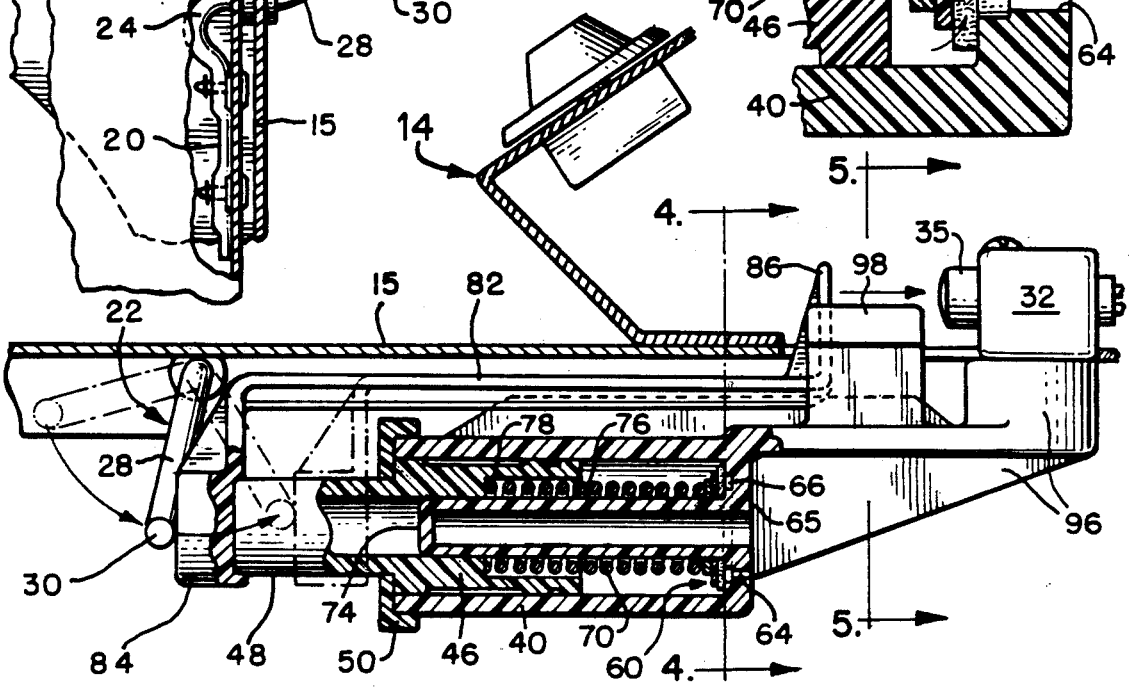
FIG. 2

FIG. 3
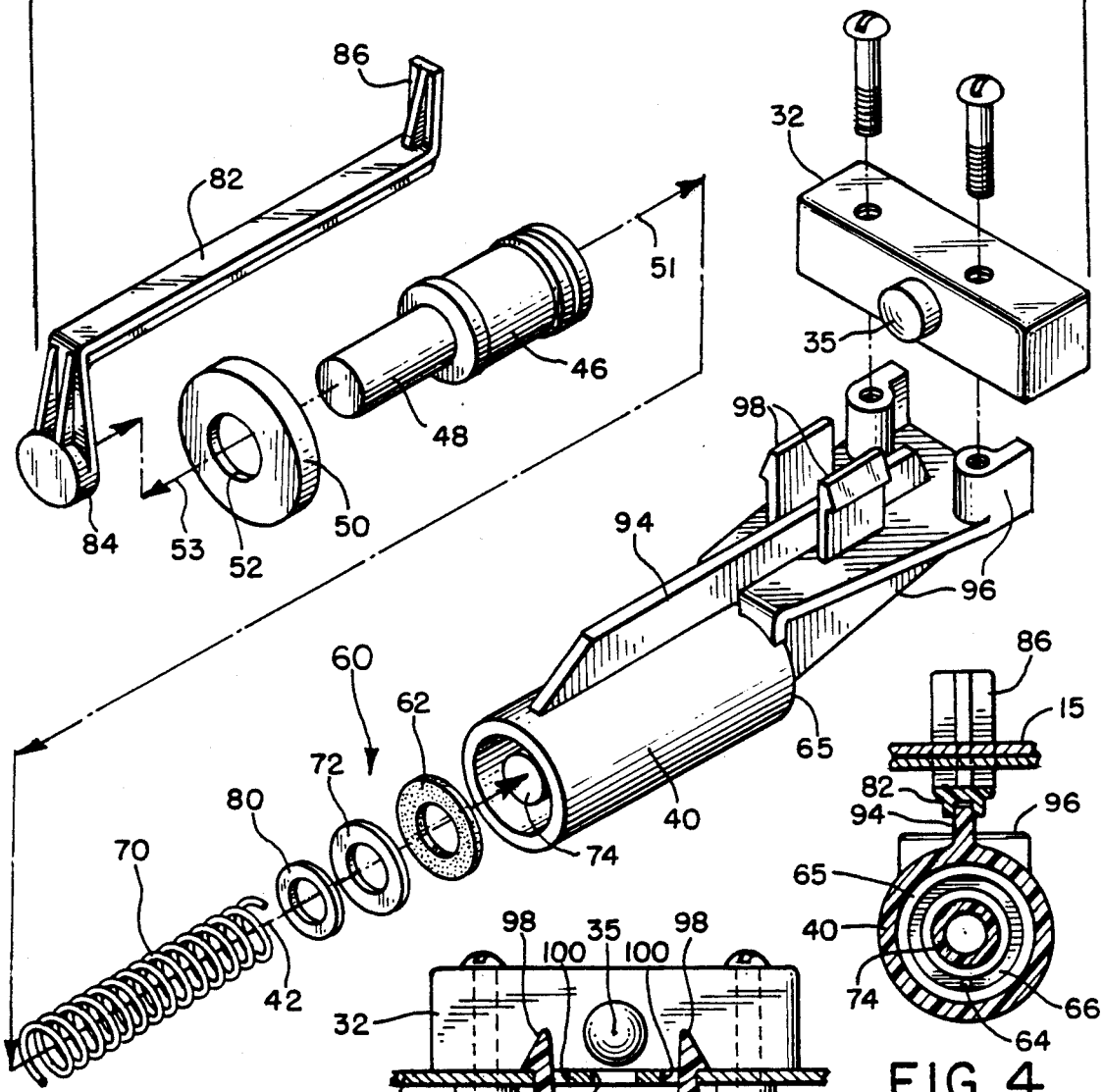
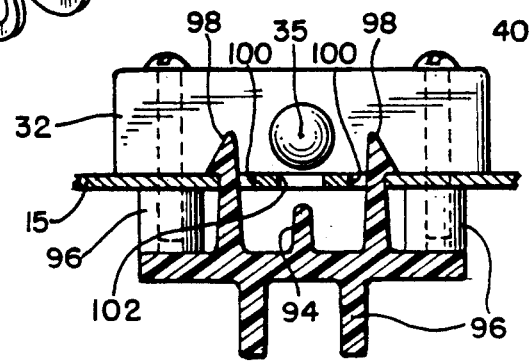
FIG. 4
FIG. 5

HINGE BRAKE

BACKGROUND OF THE INVENTION

This invention is concerned with a device for controlling the relative speed of either opening or closing of a hinged door or door-like member while permitting free movement of the hinged door or like member in the opposite direction.

In order to facilitate the ensuing description, and for better understanding, the term "hinge brake" as used herein refers to the foregoing type of device. Such devices have elsewhere been referred to as door checks, door closure devices and the like.

While door check devices for relatively large hinged doors are known in the art, such devices are generally relatively large and cumbersome having a great many complex interfitting parts and are relatively expensive in their manufacture and assembly. The present invention, however, is directed to a novel and improved device for use with relatively small doors such as those found on appliances or the like. It is often desirable to control the rate of either opening or closing of such doors, as the case may be, to avoid damage to the appliance. More particularly, the description will be facilitated by specific reference to clothes washing machines, dishwashing machines, and the like wherein it is further desirable to deactivate the machine in the event the door is opened during operation thereof.

Accordingly, the present invention is concerned with a novel and improved device which will not only control the rate of door closing in a washing machine or the like, but will also provide a suitable means for actuating a signaling device such as a switch or the like for interrupting operation of the machine upon initial opening of the door from its fully closed position. In this regard, it should be recognized that it is important to interrupt the machine operation within a relatively few degrees of movement of the hinged door from its fully closed position to avoid the ejection of water, soap, liquids or the like from the machine, as well as to prevent access to moving parts by the machine operator.

In addition, such appliances are price-competitive in the marketplace, and as such, it is important to minimize the cost of additional features and apparatus provided thereupon. Accordingly, the combined closure and signaling device in accordance with the invention is also advantageously designed in such a manner that it can be constructed, assembled, and installed upon the washing machine or the like at but a minimum of additional expense, thus not adding significantly to the cost of the machine.

OBJECTS AND SUMMARY OF THE INVENTION

Accordingly, it is an object of this invention to provide a novel and improved hinge brake device for an appliance.

Briefly, in accordance with the foregoing discussion and object, a hinge brake apparatus for controlling the rate of one of opening and closing of a door or the like while permitting the other of opening and closing thereof freely at a desired rate comprises cylinder means including a tubular member having a longitudinal axis and at least one open end; piston means for axially slidably interfitting in telescoping relation with said cylinder means in a substantially air tight fit with respect to said at least one open end thereof for sealing the same in a sliding seal; air flow control means disposed adjacent the end of said cylinder opposite said one end for controlling the flow of air between the interior and exterior of said cylinder in response to travel of the piston in one axial direction relative to said axis; and check valve means for permitting free flow of air between said exterior and said interior of said cylinder means in response to said travel of said piston means in the axial direction opposite said first direction and for confining air flow between the interior and exterior of said cylinder means in response to travel of said cylinder in said one direction substantially to said air flow control means.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

FIG. 1 is partial perspective view of an appliance having a hingedly mounted door, in connection with which the hinge brake apparatus of the present invention is advantageously utilized;

FIG. 2 is an enlarged sectional view illustrating further details of the apparatus of the invention in connection with an appliance of the type shown in FIG. 1;

FIG. 3 is an exploded perspective view of the apparatus of the invention;

FIG. 4 is a partial sectional view taken generally in 15 the plane of line 4—4 of FIG. 2;

FIG. 5 is a partial sectional view taken generally in the plan of the line 5—5 of FIG. 2;

FIG. 6 is a partial sectional view taken generally along the line 6—6 of FIG. 1; and FIG. 7 is an enlarged partial sectional view illustrating further details of the section of the apparatus illustrated in FIG. 2.

DETAILED DESCRIPTION OF THE ILLUSTRATED EMBODIMENT

Referring to the drawings, and initially to FIG. 1, a hinge brake device in accordance with the invention is designated generally by the reference numeral 10. In the embodiment illustrated herein for purposes of description, the hinge brake apparatus or assembly 10 is shown in connection with a hinged door 12 of an appliance 14, such as a washing machine. However, it will be understood that the apparatus of the invention may readily be used in connection with other similar machines or devices without departing from the invention.

The door 12 is hinged for movement generally along an edge 16 thereof. In the illustrated embodiment, one lateral edge 18 of the door is coupled to a first elongate arm or extension 20 of a combined hinge and actuator driver apparatus 22 which will be more fully described later herein. A mid-portion 24 of hinge-driver device 22 is pivotally mounted to a through bore in lateral edge 18 and an aligned through bore in a recessed portion 23 of a top panel 15 of machine 14 which faces the edge 16 of the door 12. An additional washer or spacer 26 is also provided between the respective surfaces 18 and 23. An actuator driver portion 28 of the member 22 extends in a generally perpendicular direction to the first-mentioned arm or extension 20 and an end part 30 thereof is arranged for abutting an end part of the device 10 of the invention, at least during a portion of the hinged movement of the door 12 between its fully open and fully closed positions, as will be more fully described later herein.

The device 10 of the invention may also be provided with means (to be described later) for actuating a switch or other signaling device 32 in order to provide a signal corresponding to the position of the door 12. In many machines such as washing machines or the like, such a signal may be utilized to interrupt operation of the machine when the door 12 is opened an initial relatively small amount from its fully closed position. This is done in order to prevent the ejection of water, soap or the like from the machine, and also in order to prevent contact with the moving interior parts of the machine.

Reference is next invited to the remaining figures of drawing, and initially to FIG. 3, wherein further details of the apparatus of the invention are illustrated. As best viewed in FIG. 3, the apparatus 10 comprises a cylinder or cylinder means 40 which is a generally tubular member having a longitudinal axis 42. The cylinder member 40 also preferably has at least one open end 44 which receives a piston member or piston means 46 in an axially slidable telescoping relation. Preferably, the piston member 46 is configured for a substantially air tight fit within the cylinder 40 for sealing the same in a sliding seal. A projection portion 48 of the piston 46 also projects outwardly of the open end 44 of the cylinder 40 to varying degrees or extents as the piston slidably moves within cylinder 40. An end cap member 50 is also provided for covering the open end 44 of cylinder 40 and has a through opening 52 for receiving projecting piston end 48 therethrough.

In accordance with a feature of the invention, the apparatus 10 is arranged for controlling the rate of one of opening and closing of the door 12 while permitting the other of opening and closing thereof freely at a desired rate. In the illustrated embodiment, it is the closing motion of the door 12 which is controlled by the apparatus 10 of the invention. However, it will be recognized that the apparatus may be configured and coupled with the door 12 for controlling the opposite or opening motion thereof as well without departing from the invention.

To this end, a one-way air flow control assembly or means designated generally by reference numeral 60 is disposed adjacent the end of the cylinder opposite its open end 44 (see also FIG. 2). This flow control assembly or means 60 is arranged for controlling the flow of air between the interior and exterior of the cylinder in response to travel of the piston 46 in one axial direction 51 relative to axis 42. In the illustrated embodiment, this direction 51 is the direction moving generally from left-to-right, as viewed in both FIGS. 2 and 3, that is, with the piston generally telescoping into the cylinder 40. Cooperatively, a further check valve means, which as will be seen later is incorporated within the flow control means 60, permits free flow of air between the exterior and interior of the cylinder means in response to travel of the piston means 46 in the opposite direction 53. In the illustrated embodiment, this opposite direction 53 is generally from right-to-left as viewed in FIGS. 2 and 3, that is, with the piston telescoping back outwardly of cylinder 40. This check valve means is further arranged such that it substantially confines or limits air flow between the interior and exterior of the cylinder 40 in such a manner that it must flow through the air flow control means 60, when the piston moves in first direction 51.

In the preferred embodiment illustrated herein, the air flow control means comprises a filter membrane 62 of controlled porosity which is disposed adjacent a through bore or opening 64 in an end wall of the cylinder 40. This through bore 64 also intersects a generally annular groove 66 (see FIG. 4) in an inner surface of the end wall 65.

In the illustrated embodiment, the apparatus 10 also includes a resilient biasing means, which here takes the form of an elongate helical compression spring 70. The biasing means or spring 70 is operatively coupled intermediate the cylinder 40 and piston 46 for resiliently biasing the piston in the opposite direction 53, that is, the direction which the check valve permits free flow of air between exterior and interior of the cylinder 40. In the illustrated embodiment, this is the direction for opening of the door 12. During this movement, the piston and cylinder generally "recover" from the "collapsed" or "compressed" condition as shown in FIG. 7 and assume a rest or "uncompressed" condition as shown in full line in FIG. 2.

Further mounting means are provided for mounting the filter membrane 62 in the cylinder 40 with a generally radially outer annular portion of the filter membrane being left free to flex at least in the direction of movement 53 of the piston 40 during opening of the door, that is, under the influence of the spring 70. This flexing or movement is such as to permit a relatively free flow of air from outside of the cylinder through the aperture 64 and groove 66, that is, with the filter membrane 62 flexed slightly away from the latter. This in turn defines the check valve means or function of the assembly 60 as previously mentioned.

Conversely, with the motion of the piston in the direction 51 of closing of the door, air is forced against the radially outer portion of the filter membrane 62, such that the latter will be held firmly against annular groove 66 and through opening 64. Accordingly, the rate of flow of air from the interior to the exterior of the cylinder will be controlled almost entirely by the selection of porosity of the material chosen for filter membrane 62.

In accordance with the embodiment illustrated herein, the filter membrane 62 is an annular, flexible, disc-like member and the mounting means for mounting the same in the fashion noted above includes a first generally annular and preferably resilient rubber or rubber-like member 72. This mounting member 72 is preferably of somewhat smaller outer diameter then the outer diameter of filter membrane 62. However, during the flexing of the latter away from the groove 66 as mentioned hereinabove, the resilient annular mounting means or member 72 also is sufficiently flexible to flex somewhat therewith, at least at its radially outer portion, to permit sufficient movement of the filter membrane away from the annular groove 66 to permit relative free air flow into the cylinder 40. This in turn permits reinflation of the cylinder and resilient return under the influence of spring 70 to its fully extended position as illustrated in full line in FIG. 2. This free resilient return under the influence of spring 70 is important for accommodating a second related function of the apparatus 10 of the invention, namely, that of actuating and deactuating the switch or other circuit component 32 as mentioned hereinabove, and as will be more fully described hereinbelow.

In order to properly mount and position the annular member 62 and 72, as well as the helical compression spring 70, the cylinder is provided with a central axial shaft-like portion 74. Cooperatively, the piston 46 has a hollow interior 76 which is sized for slidably engaging the shaft 74 and also has a stepped-down portion defining a shoulder or abutment surface 78 for engaging the axially outer end of the spring 70. The opposite end of the spring is engaged by a further stop or abutment means or surface, which in the illustrated embodiment comprises a relatively rigid annular member 80 which is superimposed over respective annular members 62 and 72. However, the annular member 80 is of smaller diameter so as to permit the above-described flexing of members 62 and 72 in the direction for reinflating or returning the piston and cylinder to the position shown in full line in FIG. 2.

As briefly described above, the illustrated embodiment also preferably includes means for actuating and deactuating a switching component or other signaling means 32 to provide means for indicating whether the door 12 is in its open or closed position. Preferably this signal corresponding to the open or closed position of the door is also used to activate or deactivate some mechanism of the washing or other machine, as appropriate, as also briefly described hereinabove.

To this end, an elongate actuator member 82 is coupled to move in unison with the piston member or means 46. The elongate member 82 has a depending end portion terminating in a generally cylindrical cap-like portion 84 which preferably snappingly or otherwise engages with the terminal end of outwardly extending end portion 48 of the piston 46. A quantity of adhesive or the like may also be applied to secure this connection, if desired. The elongate member 82 terminates at its opposite end in an upwardly projecting actuating finger or abutment member or portion 86 for engagement with actuator 35 of the switch or other signaling component 32. Preferably, the elongate member 82 is also arranged with a pair of elongate, parallel ridges 90, 92 which are arranged to engage and slidably ride along an upwardly projecting ridge 94 formed on an upper portion of the body of the cylinder 40.

In the embodiment illustrated herein, the cylinder 40 is also provided with an outwardly extending bracket-like portion or means 96 for mounting the signaling means or switch 32 thereto so that the two may be readily assembled with an appliance such as washing machine 14 in the correct relative orientations. The length of the bracket portion 96 is also suitably selected to assure the desired activation and deactivation of the switch 32 upon an appropriate amount of slidable movement of actuator member 82. That is, the arrangement is such that the switch will be rapidly deactuated upon a relatively small initial amount of movement of the door 12 away from its fully closed position, as described hereinabove. Preferably, the bracket 96 further includes a pair of upwardly projecting mounting tabs or ears 98 which further serve to guide respective lateral outer edges of the actuator member 82 as it slides along the track or ridge 94 therebetween. These mounting tabs or ears 98 are further arranged to snappingly engage complementary mounting apertures 100 provided therefore in a suitable surface of the machine or appliance 14. A further central through aperture 102 is also provided to receive the actuator arm or finger portion 86 of the actuator member 82 therethrough. The arrangement is such that the switch and the assembly 10 may be mounted to opposite sides of a panel 10 of the machine or appliance 14.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A hinge brake apparatus for controlling the rate of one of opening and closing of a door or the like while permitting the other of opening and closing thereof freely at a desired rate, said hinge brake apparatus comprising: cylinder means including a tubular member having a longitudinal axis and at least one open end; piston means for axially slidably interfitting in telescoping relation with said cylinder means in a substantially air tight fit with respect to said at least one open end thereof for sealing the same in a sliding seal; air flow control means disposed adjacent the end of said cylinder opposite said one end for controlling the flow of air between the interior and exterior of said cylinder means in response to travel of the piston in one axial direction relative to said axis; and one-way check valve means for permitting free flow of air between said exterior and said interior of said cylinder means in response to said travel of said piston means in the axial direction opposite said first direction and for confining air flow between the interior and exterior of said cylinder means in response to travel of said piston means in said one direction substantially to said air flow control means; wherein said air flow control means comprises means comprises a filter membrane of controlled porosity.

2. Apparatus according to claim 1 and further including resilient biasing means operatively coupled intermediate said cylinder and said piston for resiliently biasing said piston in said opposite direction.

3. Apparatus according to claim 2 wherein said resilient biasing means comprises a helical compression spring and wherein said cylinder means further includes a central axial shaft-like portion for receiving said spring thereabout, and wherein said piston member has a hollow interior sized for slidably engaging said shaft-like means and including means therein defining an abutment surface for engaging a first, axially outer end of said spring.

4. Apparatus according to claim 3 and further including stop means at said opposite end of said cylinder means for abutting an end of said spring opposite the end thereof in engagement with said abutment surface.

5. Apparatus according to claim 3 wherein said air flow control means comprises a generally annular filter membrane of controlled porosity disposed coaxially about said axially central shaft means and perforated wall means at said opposite end of said cylinder means for holding said filter membrane in place relative to said opposite end while permitting a flow of air externally of said cylinder means to flow through said filter membrane.

6. Apparatus according to claim 5 and further including a relatively rigid annular member of lesser outer diameter than said filter membrane and located at a side thereof opposite said cylinder opposite said end, an opposite side of said annular relatively rigid member also abutting an end of said spring opposite said first axially outer end thereof.

7. Apparatus according to claim 6 and further including a resilient, compressible annular member interposed intermediate said filter membrane and said relatively rigid annular member.

8. Apparatus according to claim 1 and further including an elongate actuator member coupled with said piston means and extending in an axial direction for actuating a signaling means associated with said door or the like for producing signals corresponding to the open and closed conditions thereof.

9. Apparatus according to claim 8 wherein said cylinder means also includes mounting bracket means operatively coupled therewith for mounting said signaling means thereto in a position for selective actuation by said actuator means.

10. Apparatus according to claim 8 wherein said signaling means comprising a switch.

11. Apparatus according to claim 10 wherein said switch and said actuator means are so positioned and dimensioned relative to the piston means and cylinder means as to actuate such switch to a first condition upon closing of the associated door or the like substantially to a fully closed position and for actuating said switch to a second condition upon initial movement of said door away from said fully closed position.

12. Apparatus according to claim 1 and further including a pivotally mounted drive member having one end arranged for abutment with an axially outermost end of said piston member during at least a portion of the hinged movement of said door between its fully open and fully closed positions, and an opposite end arranged for connection with said door or the like for generally converting hinged motion of said door to linear motion of said piston means in at least one direction.

13. Apparatus according to claim 12 wherein said drive member is arranged for converting hinged motion of said door or the like in the direction of closing thereof to linear motion in the direction for driving said piston in said one axial direction wherein the flow of air is controlled by said air flow control means, to thereby control the rate of closing of said door.

14. A hinge brake apparatus for controlling the rate of one of opening and closing of a door or the like while permitting the other of opening and closing thereof freely at a desired rate, said hinge brake apparatus comprising: cylinder means including a tubular member having a longitudinal axis and at least one open end; piston means for axially slidably interfitting in telescoping relation with said cylinder means in a substantially air tight fit with respect to said at least one open end thereof for sealing the same in a sliding seal; air flow control means comprising a filter membrane of controlled porosity disposed adjacent the end of said cylinder opposite said one end for controlling the flow of air between the interior and exterior of said cylinder means in response to travel of the piston in one axial direction relative to said axis; one-way check valve means for permitting free flow of air between said exterior and said interior of said cylinder means in response to said travel of said piston means in the axial direction opposite said first direction and for confining air flow between the interior and exterior of said cylinder means in response to travel of said piston means in said one direction substantially to said air flow control means; and mounting means for mounting said filter membrane to said cylinder with a portion of said filter membrane free to flex in said opposite direction to thereby define said one-way check valve means.

15. Apparatus according to claim 14 wherein said filter membrane comprises an annular, flexible disc-like member and wherein said mounting means comprise an annular, resilient member of lesser outer diameter than said filter membrane and mounted adjacent thereto so as to permit said flexing of a radially outer annular portion of both said filter membrane and said resilient member in said one direction, generally about an outer periphery of said resilient annular member.

16. Apparatus according to claim 15 and further including a helical compression spring interposed between the cylinder and the piston for resiliently biasing the piston in said opposite direction, and a relatively rigid annular member of lesser outer diameter than said annular, resilient member and interposed thereover for abutting one end of said spring.

17. A hinge brake apparatus for controlling the rate of one of opening and closing of a door or the like while permitting the other of opening and closing thereof freely at a desired rate, said hinge brake apparatus comprising: cylinder means including a tubular member having a longitudinal axis and at least one open end; piston means for axially slidably interfitting in telescoping relation with said cylinder means in a substantially air tight fit with respect to said at least one open end thereof for sealing the same in a sliding seal; air flow control means disposed adjacent the end of said cylinder opposite said one end for controlling the flow of air between the interior and exterior of said cylinder means in response to travel of the piston in one axial direction relative to said axis; check valve means for permitting free flow of air between said exterior and said interior of said cylinder means in response to said travel of said piston means in the axial direction opposite said first direction and for confining air flow between the interior and exterior of said cylinder means in response to travel of said piston means in said one direction substantially to said air flow control means; and resilient biasing means operatively coupled intermediate said cylinder and said piston for resiliently biasing said piston in said opposite direction; wherein said resilient biasing means comprises a helical compression spring and wherein said cylinder means further includes a central axial shaft-like portion for receiving said spring thereabout, and wherein said piston member has a hollow interior sized for slidably engaging said shaft-like means and including means therein defining an abutment surface for engaging a first, axially outer end of said spring.

* * * * *